US006164000A

United States Patent [19]

Lumplecker et al.

[11] Patent Number: 6,164,000

[45] Date of Patent: Dec. 26, 2000

[54] REPEATING RIFLE WITH MAGAZINE ADAPTER

[75] Inventors: Johann Lumplecker, Garsten; Erwin Derntl, Steyr, both of Austria

[73] Assignee: Steyr-Daimler-Puch Aktiengesellschaft, Vienna, Austria

[21] Appl. No.: 09/185,312

[22] Filed: Nov. 3, 1998

[30] Foreign Application Priority Data

Nov. 4, 1997 [AT] Austria ..... 689/97 U

[51] Int. Cl.[7] ..... F41A 9/61

[52] U.S. Cl. ..... 42/6; 42/17; 42/18; 42/21; 42/22

[58] Field of Search ..... 42/6, 17, 18, 21, 42/22, 49.01, 49.02, 50; 89/33.1, 34

[56] References Cited

U.S. PATENT DOCUMENTS

| | | | |
|---|---|---|---|
| 393,406 | 11/1888 | Von Stepski et al. | 42/18 |
| 940,191 | 11/1909 | Rebman | 42/18 |
| 1,230,012 | 6/1917 | Moore | 42/18 |
| 1,260,991 | 3/1918 | Hammond | 42/18 |
| 1,347,756 | 7/1920 | Payne | 42/18 |
| 1,404,040 | 1/1922 | Mader | 42/22 |
| 1,446,763 | 2/1923 | Nelson | 42/18 |
| 1,886,113 | 11/1932 | Lutton | 42/18 |
| 1,898,670 | 2/1933 | Laudensack | 42/18 |
| 2,205,967 | 6/1940 | Wise | 42/49.01 |
| 2,224,928 | 12/1940 | Reising | 42/16 |
| 2,348,790 | 5/1944 | Kiraly et al. | 89/33.1 |
| 2,482,842 | 9/1949 | Crockett | 42/18 |
| 3,019,542 | 2/1962 | Manthos | 42/18 |
| 3,067,730 | 12/1962 | Merz | 42/17 |
| 3,803,739 | 4/1974 | Haines et al. | 42/6 |
| 4,056,038 | 11/1977 | Rath | 89/128 |
| 4,237,638 | 12/1980 | Trexler | 42/6 |

*Primary Examiner*—Darren W. Ark
*Attorney, Agent, or Firm*—Bachman & LaPointe, P.C.

[57] ABSTRACT

A repeating rifle having a chamber to which a magazine guide is secured by means of threaded bolts, into which magazine guide a bar magazine can be inserted, can selectively receive a longer magazine. In order to make this possible with a minimum of parts and manual operations, there is provided an adapter which fits onto the chamber or onto a stock and is secured by means of bolts which are screwed into threaded bores in that end of the threaded bolts which faces away from the chamber.

2 Claims, 3 Drawing Sheets

REPEATING RIFLE WITH MAGAZINE ADAPTER

BACKGROUND OF THE INVENTION

The present invention relates to a repeating rifle having a chamber, to which a magazine guide is secured by means of threaded bolts, into which magazine guide a bar magazine can be inserted, the threaded bolts extending parallel to the direction of insertion.

This type of magazine guide is customary in repeating rifles. In most cases, it is sunk in the front stock, if magazines with up to six cartridges are used. However, for many purposes it is desired selectably to use a magazine for more than six cartridges.

It is the object of the present invention to provide a magazine for more than six cartridges having a minimum of parts and manual operations.

SUMMARY OF THE INVENTION

According to the invention, in order to receive a longer bar magazine, the rifle is provided with an adapter which fits onto the chamber or onto the stock and is secured by means of bolts which are screwed into threaded bores in that end of the threaded bolts which faces away from the chamber.

As a result of the foregoing, for the conversion the magazine guide does not need to be removed; rather, the adapter is simply fitted on and secured to the threaded bolt by means of further bolts. If the adapter is to be retrofitted to an existing weapon, it is merely necessary to replace the threaded bolts by threaded bolts having additional threaded bores.

In a preferred embodiment in the case of repeating rifles having a front stock, the adapter is a stock-type shaped part which partially engages over the stock and the floor of which has a recess in which the longer bar magazine is snapped. As a result of this, the adapter may be designed in such a way that it forms, together with the stock, a visual unit without edges impairing handling.

BRIEF DESCRIPTION OF THE DRAWINGS

In the text which follows, the innovation is described and explained with reference to illustrations. In the illustrations.

DETAILED DESCRIPTION

Figure 1:
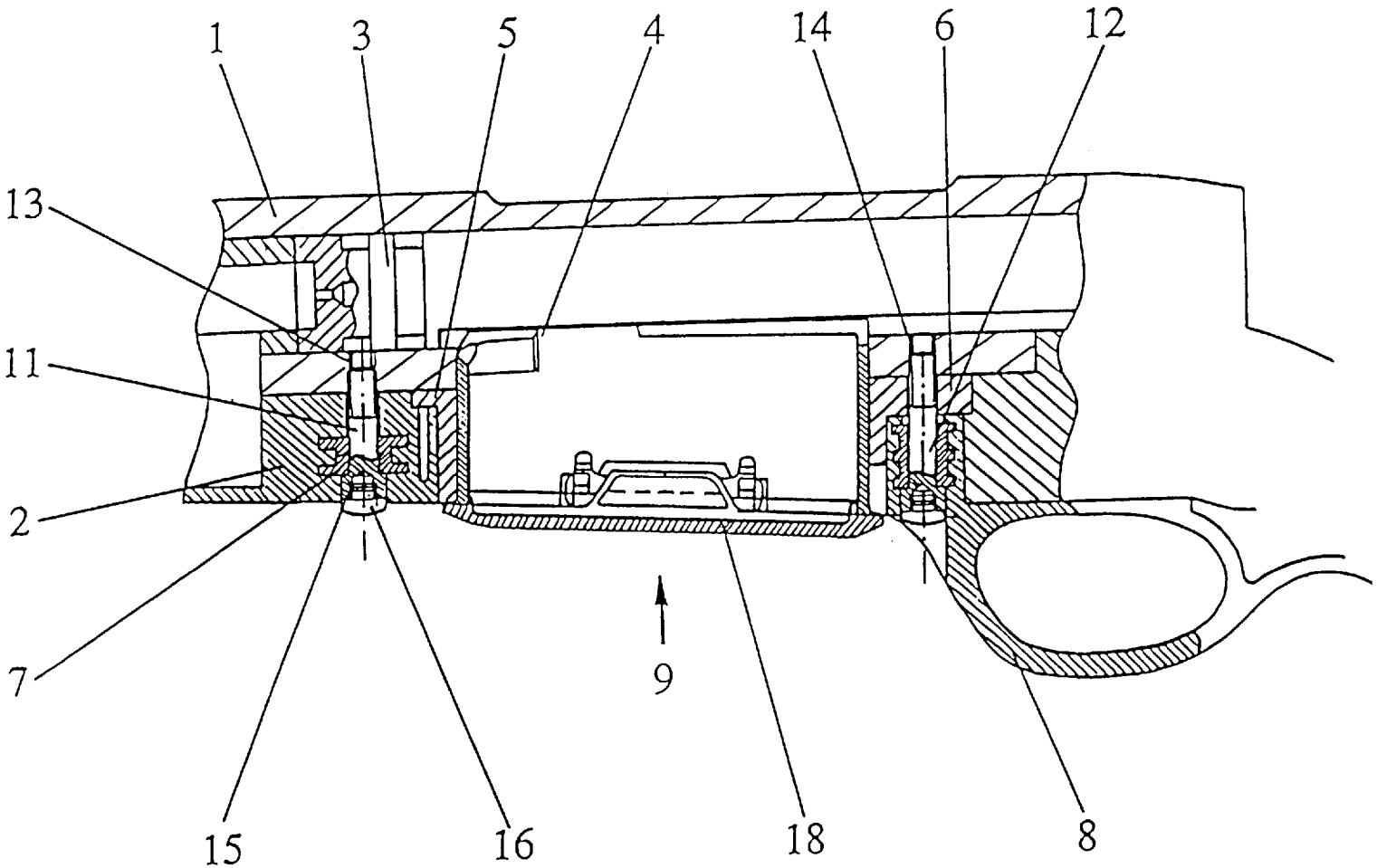
FIG. 1—shows a longitudinal cross section through a repeating rifle having a conventional magazine.

In FIG. 1 the chamber of a repeating rifle is designated by 1 and its stock by 2. A lockable breech cylinder 3 is rotatably and displaceably guided within the chamber 1. The chamber 1 has, at the bottom, an aperture 4 at which a magazine guide 5 is fitted, which fits right round onto the aperture 4 and has, at the back, a securing lug 6. In the case of a rifle without a front stock, the magazine guide 5 could be screwed directly to the chamber 1. In the illustrative embodiment shown, an intermediate piece 7 is provided; in this case, the stock, which merges at the back into a trigger guard 8, is clamped in sandwich fashion between the intermediate piece 7 and the chamber 1.

The direction of insertion of a magazine 18 is indicated by the arrow 9. There extends in this direction two threaded bolts 11, 12 which serve to secure the magazine guide 5 and the stock 2. To this end, the forward threaded bolt 11 is screwed into a threaded bore 13 of the chamber 1 and thus connects the intermediate piece 7 and the stock 2 to the chamber 1. The rear threaded bolt 12 is screwed into a threaded bore 14 of the chamber; in this case it penetrates the lug 6. Both threaded bolts 11, 12 have at their ends facing away from the chamber 1 a head with smaller threaded bores 15, which are sealed in this instance by milled bolts 16. The customary small magazine for approximately six cartridges is designated by 18; it could be equivalent, for example, to that described in Austrian Utility Model Application 338/96. The walls 19 of this magazine are guided in the magazine guide 5.

Figure 2:
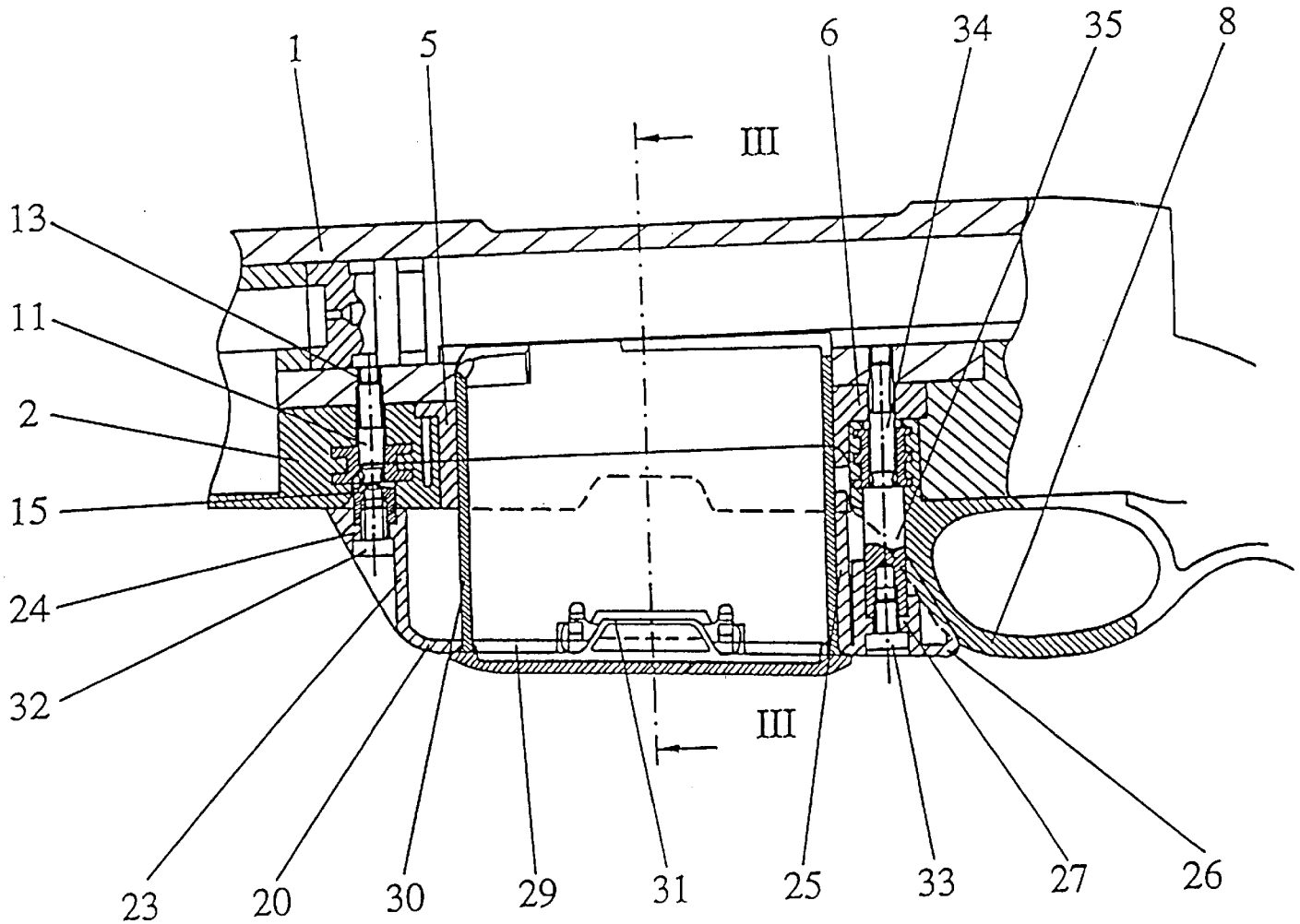
FIG. 2—shows a longitudinal cross section through a repeating rifle having the adapter according to the innovation and a larger magazine.
Figure 3:
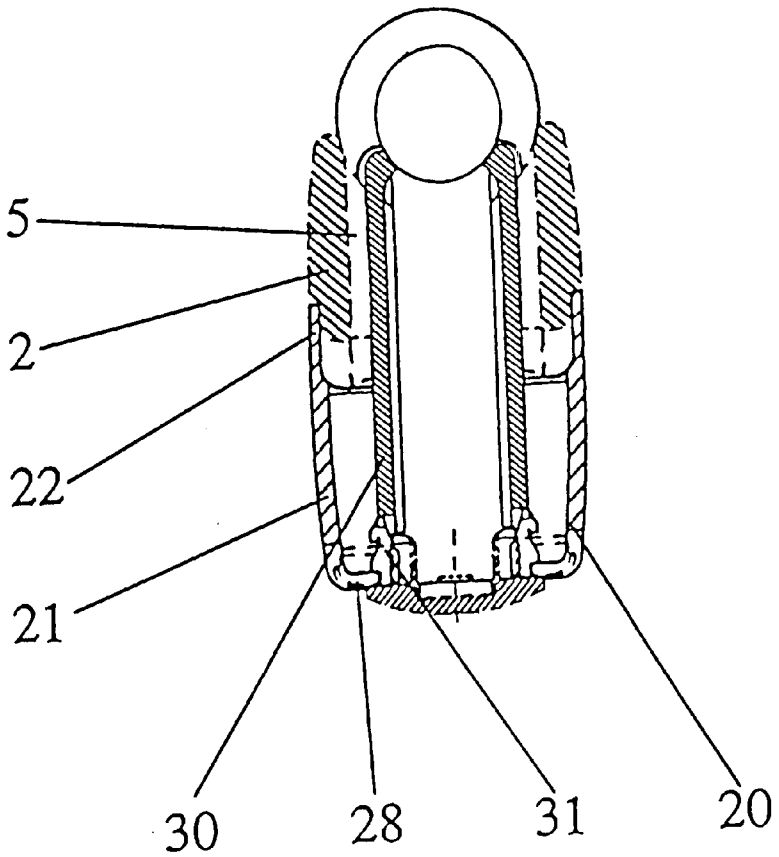
FIG. 3—shows a cross section according to III—III in FIG. 2.

FIGS. 2 and 3 show the same weapon with an adapter 20 to receive a longer bar magazine 30. The adapter 20 is a shaped part having side walls 21, the upper margin of which form overlaps 22 (FIG. 3) at the stock 2 and thus have a good fit onto it. The front wall 23 of the adapter 20 has a horizontal shoulder 24 for securing by means of a bolt; its position with respect to the magazine guide 5 can be selected freely on the basis of strength aspects and on the basis of aesthetic aspects. A rear wall 25 of the adapter 20 merges into a projection 26, which has a shoulder 27 for securing. The projection 26 may be shaped in such a way that it also merges smoothly into the trigger guard 8. In the floor 28 of the adapter 20 there is provided a recess 29 into which the long bar magazine 30 can be inserted and snapped, for example by means of snap detents 31. Since the recess 29 lies in the projection of the magazine guide 5, the two can also jointly guide the long bar magazine 30 in a neat fashion.

The adapter 20 is secured by means of bolts 32,33. The bolt 32 is screwed, in place of the milled bolt 16, into the small threaded bore 15 in the head of the threaded bolt 11 and thus clamps the shoulder 24 of the adapter 20. In this instance, the rear bolt 33 is screwed into the extended body 35 of a threaded bolt 34 and thus fixedly retains the shoulder 27 of the adapter 20. In this instance, the threaded bolt 34 takes the place of the threaded bolt 12 of FIG. 1, in order to arrange the shoulder 27 further down and thus to be able to achieve a more favorable shape of the adapter 20. However, the threaded bolt 12 could also be used in a similar way to the threaded bolt 11.

When, in the course of operation, a changeover is to be made from the normal magazine 18 to the longer magazine 30, in the first instance the small magazine 18 is taken away, the milled bolts 16 are removed from the threaded bolts 11, 12 and the adapter is fitted on and secured by means of the bolts 32, 33. In the illustrative embodiment illustrated, it is additionally also necessary to replace the threaded bolt 12 by the threaded bolt 34. The large magazine 30 can now be used.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A repeating rifle having a stock and a chamber, to which a magazine guide is secured by means of first threaded bolts, into which magazine guide a first bar magazine can be inserted, the threaded bolts extending parallel to the direction of insertion, the improvement which comprises the first threaded bolts have threaded bores on ends thereof which face away from the chamber and adapter means for receiving a second bar magazine which is longer than the first bar magazine, that fits onto one of the chamber or stock and is secured by means of additional bolts which are screwed into said threaded bores in said ends of the first threaded bolts which face away from the chamber.

2. The repeating rifle as claimed in claim 1, wherein the adapter means is a shaped part which partially overlaps the stock, the adapter means has a floor and the floor has a recess in which the second bar magazine can be fixed.

* * * * *